United States Patent [19]

Anthes et al.

[11] Patent Number: 4,851,036

[45] Date of Patent: Jul. 25, 1989

[54] MINERAL ORE FLOTATION PROCESS AND APPARATUS

[75] Inventors: Robert J. Anthes, Hamilton Square; Ross A. Kremer, Ringoes; Susanne Von Rosenberg, Princeton, all of N.J.

[73] Assignee: Mobil Oil Corporation, New York, N.Y.

[21] Appl. No.: 98,337

[22] Filed: Sep. 18, 1987

Related U.S. Application Data

[63] Continuation-in-part of Ser. No. 83,906, Aug. 6, 1987, abandoned, which is a continuation of Ser. No. 822,347, Jan. 24, 1986, abandoned.

[51] Int. Cl.[4] ..... B03D 1/00; C22B 1/00

[52] U.S. Cl. ..... 75/2; 423/29; 423/87; 423/335; 423/339; 423/55; 423/65; 423/69; 423/92; 423/101; 423/122; 423/140; 423/158; 209/162; 209/158; 209/164; 209/166; 209/168; 209/159; 209/170; 209/178; 210/221.2; 210/703; 210/705

[58] Field of Search ..... 209/162, 158, 164, 166, 209/168, 159, 170, 178; 210/221.2, 703, 705; 423/26, 87, 335, 339, 55, 65, 69, 87, 92, 101, 122, 140, 150; 75/2, 97

[56] References Cited

U.S. PATENT DOCUMENTS

| | | | |
|---|---|---|---|
| 1,744,785 | 1/1930 | McTaggart | 209/168 |
| 2,182,442 | 12/1939 | Booth | 209/168 |
| 2,651,413 | 9/1953 | Daman | 209/168 |
| 3,298,519 | 1/1967 | Hollingsworth | 209/170 |
| 3,371,779 | 3/1968 | Hollingsworth et al. | 209/170 |
| 4,172,029 | 10/1979 | Hefner, Jr. | 209/166 |
| 4,227,996 | 10/1980 | Levine et al. | 209/166 |
| 4,287,054 | 9/1981 | Hollingsworth | 209/170 |
| 4,431,531 | 2/1984 | Hollingsworth | 209/170 |
| 4,440,636 | 4/1984 | Lilley | 209/167 |

*Primary Examiner*—Robert L. Stoll
*Assistant Examiner*—Paige C. Harvey
*Attorney, Agent, or Firm*—Alexander J. McKillop; Charles J. Speciale; Stanislaus Aksman

[57] ABSTRACT

There is disclosed a process and an apparatus for beneficiating a mineral ore, such as phosphate-containing ore, in a substantially vertical column. The feed subjected to the benefication preferably has a particle size of less than 20 mesh. The feed is introduced into the column, containing at least one baffle, into which there is also introduced a gas at the bottom portion thereof and a liquid through at least one column inlet at the top of the column. The baffle and the rates of introduction of the feed, the gas, and the liquid are such as to create relatively high turbulence conditions within the column. The enriched, beneficiated product is removed at the top of the column, while the waste products, such as silica-containing material, in the case of a phosphate ore, are recovered at the bottom of the column. The column is either used as a single step flotation apparatus to recover mineral ore, or, preferably, as an apparatus of a multi-step flotation process wherein the rougher flotation step is carried out in the column and a subsequent cleaner flotation step in a conventional flotation apparatus, e.g., a Denver Flotation Cell.

65 Claims, 3 Drawing Sheets

MINERAL ORE FLOTATION PROCESS AND APPARATUS

CROSS-REFERENCE TO RELATED APPLICATION

This is a continuation-in-part of Ser. No. 083,906 filed on Aug. 6, 1987, now abandoned, which was a continuation of Ser. No. 822,347, filed on Jan. 24, 1986, now abandoned the entire contents of both of which are incorporated hereinby reference.

BACKGROUND OF THE INVENTION

1. Field of the Invention

This invention relates to an improvement in beneficiating mineral ores, especially phosphate ores. More particularly, the invention relates to a method and apparatus for separating and enriching mineral values from mineral ores.

2. Description of Prior Art

Mineral-containing ores, such as phosphate ores, are usually concentrated or beneficiated in a series of operations which results in a product having a higher content of the desired mineral than the original ores. A commonly accepted criterion of the quality of the product of the beneficiation process is "grade" of the product which, in the case of a phosphate ore, is expressed as % BPL. % BPL is a measure of phosphate, $P_2O_5$, content with the amount of the phosphate being calculated from the equation: % $P_2O_5$=% BPL×0.4576. In the case of phosphate ore, it is normally desirable to obtain a product containing at least 70% BPL, with the minimum number of processing steps and therefore at a minimum cost.

In prior art, many minerals were beneficiated in complex operations requiring multiple flotation systems. For example, in the case of phosphate ore, the ore was first mined and then slurried with water to form an aqueous slurry. The slurry was then transported, by any suitable means, e.g., a pipeline, to a beneficiation plant wherein the ore was screen to remove relatively large size particles (e.g., larger than ¾ inch). The undersized ore, in the aqueous pulp form, was subjected to several screening, washing, cyclonic and hydrosizing operations. Two separate fractions of the phosphate ore, one having the particle size range of −20 to +35 and the other of −35 to +150 mesh, commonly referred to as the coarse and the fine "flotation feed", respectively, were subjected to two separate but similar conditioning and flotation steps for further upgrading. As used herein, the term "mesh size" or "mesh" refers to standard Tyler screen mesh sizes.

In the conditioning step, the flotation feed was first contacted with chemicals, i.e., a base, a fatty acid and a hydrocarbon oil, e.g., a fuel oil, which enhanced, in a downstream flotation step, commonly called "rougher flotation", the flotation of the desired phosphate particles from the silica gangue. The phosphate product of the rougher flotation step contained some silica which had to be removed in a second flotation step, commonly called "cleaner flotation", with different chemicals from those used in the rougher flotation. The rougher flotation phosphate product was first treated with a mineral acid, e.g., sulfuric acid, and washed to remove the rougher flotation chemicals. The washed product was then treated with chemicals, e.g. an amine and kerosene, and then subjected to the cleaner flotation, wherein the residual silica was removed from the phosphate-containing product. The above-described combination of sequentially-conducted rougher and cleaner flotation steps will be referred to hereinafter as a "multiple step or two-step flotation process," usually conducted in Denver Flotation Cells. McTaggart, U.S. Pat. No. 1,744,785, Booth, U.S. Pat. No. 2,182,442, and Daman, U.S. Pat. No. 2,651,413, disclose such multiple step flotation processes for mineral ores. Hefner, Jr., U.S. Pat. No. 4,172,029, and Lilley, U.S. Pat. No. 4,440,636, disclose improvements in such conventional, multiple step flotation process. The entire contents of the aforementioned patents are incorporated herein by reference.

It was also proposed in prior art to use vertical flotation columns to separate minerals from other particulate material by froth flotation. Such flotation columns usually employed a plug flow process or utilized a relatively quiescent body of liquid to separate mineral values from non-desirable particulate material. For example, Hollingsworth, U.S. Pat. No. 3,298,519, discloses a vertical flotation column for concentrating minerals in a plug flow process. The process comprises establishing a vertical column of liquid, introducing air into the column, and introducing a mixture of particles of minerals and non-floatable particles into the column at least about two feet below the upper surface of the liquid column.

Hollingsworth, U.S. Pat. Nos. 3,371,779, 4,287,054 and 4,431,531, also disclose vertical flotation columns for concentrating mineral values. In these columns, relatively quiescent operating conditions, which may be facilitated by the presence of baffles, are maintained during the mineral beneficiating processes.

It is a primary object of the present invention to provide an improved process for recovering mineral values from mineral ores.

This and other objects of the invention will become apparent to those skilled in the art from the following description thereof.

SUMMARY OF THE INVENTION

The invention is directed to a process for separating a relatively floatable particulate material from a mixture thereof with a relatively non-floatable particulate material. The process uses a continuous flotation method with counter-current separation. The mixture of the particulate floatable material and the particulate non-floatable material is introduced into a substantially vertical column. The column must contain at least one baffle means to promote turbulence within the column, which is crucial in the process of the invention. A gaseous material, e.g., air, is introduced into the column below the point of introduction of the mixture, and a liquid is introduced into the column. The rates of introduction of the mixture, the gaseous material and the liquid, and the number of and the configuration of the baffle means must be such as to create a substantial amount of turbulence in the vertical column to recover the relatively floatable particulate material at the upper portion of the vertical column and the relatively non-floatable particulate material at the lower portion of the vertical column.

The process and column of the invention may either be used as a single-step replacement for a multiple step process and apparatus of prior art, e.g., rougher and cleaner flotation steps conducted in conventional Denver flotation cells, or as a replacement for only the first step of such a conventional multi-step process, followed by a conventional second step, e.g., as a replacement for the rougher flotation step, followed by the cleaner flotation step.

The invention is also directed to the apparatus for practicing the process.

BRIEF DESCRIPTION OF THE FIGURES

FIG. is a schematic representation of one embodiment of the flotation column of the present invention.

DETAILED DESCRIPTION OF THE INVENTION

Figure 1:
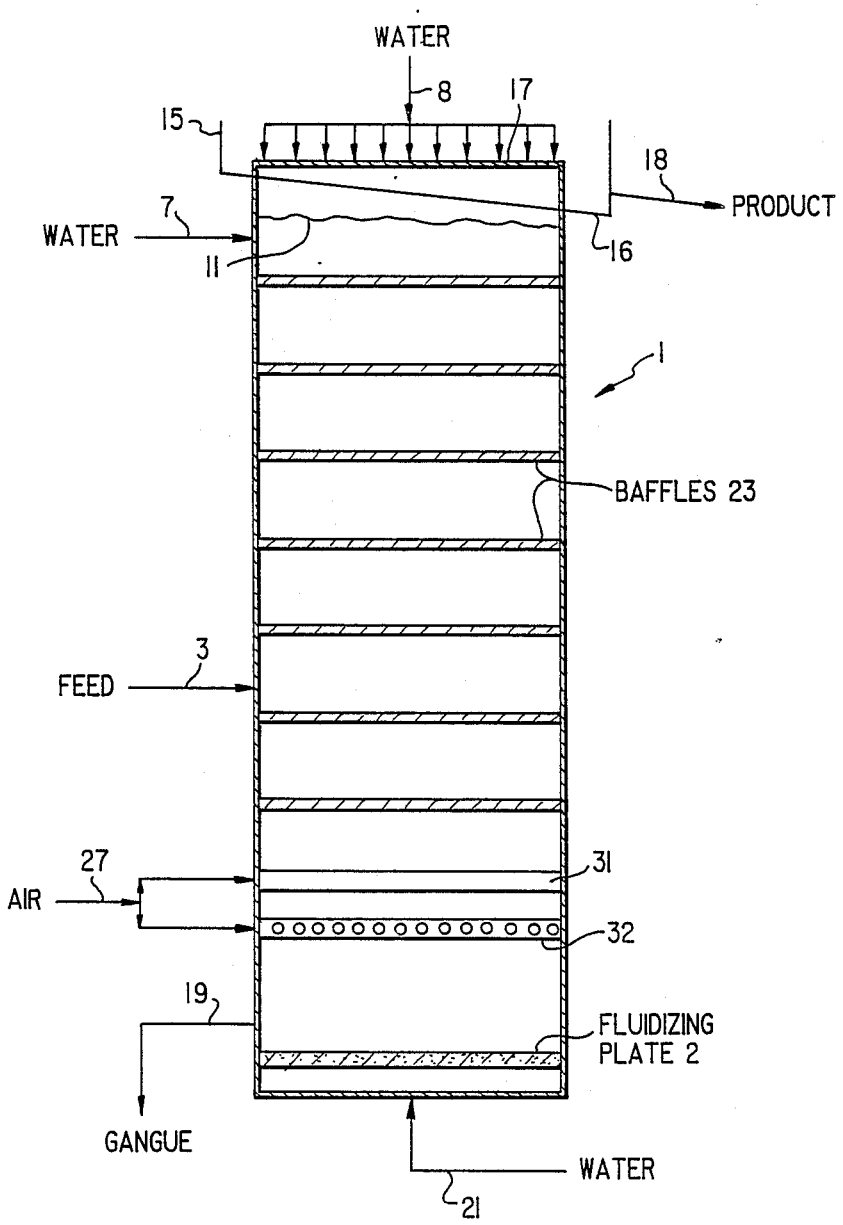

The relatively floatable particulate material is any particulate material existing in a mixture with a relatively non-floatable particulate material and which is desirably separated from such a mixture, Suitable floatable particulate materials are mineral ores, the non-limiting examples of which includes sulfides, such as cinnabar, cobaltite, molybdenite, native metals, such as gold, silver, copper, and bismuth, and phosphate-containing ores.

The most preferred ores beneficiated in the process of the present invention are phosphate-containing ores. Accordingly, for the sake of simplicity, the invention will be described in detail below in conjunction with the beneficiation of a phosphate-containing ore. However, it will be understood by those skilled in the art that neither the process nor the apparatus of the invention are limited to the use thereof with the phosphate-containing ores.

Prior to the introduction of the ore into the vertical flotation column, the phosphate-containing ore, or other relatively floatable particulate material, is sized to produce a fraction having the particle size of less than 20 mesh, preferably less than 35 mesh. The process of the invention does not operate as efficiently with particulate material having particle sizes greater than 35 mesh. The feed, due to the nature of the phosphate ore mining process, is in the form of an aqueous suspension. It contains particles of a phosphate ore, also referred to herein as a relatively floatable particulate material, and particles of gangue containing silica sand, referred to herein as relatively non-floatable particulate material.

The sized feed is conditioned in a conditioning step, also prior to the introductin thereof into the column, by mixing it with conditioning chemicals normally used in prior art to condition the feed of the phosphate flotation step. Suitable conditioning chemicals are an alkaline agent, a fatty acid and a hydrocarbon oil.

Suitable alkaline agents are bases of alkali or alkaline earth metals, such as hydroxides of lithium, sodium, potassium, and barium, ammonium hydroxide, carbonates of sodium and potassium, and mixtures thereof. The alkaline agent is usually used as an aqueous solution thereof, containing about 5 to about 15 percent of the alkaline agent in the solution. However, it will be apparent to those skilled in the art that the concentration of the alkaline agent in the aqueous solution is not critical to the process of the invention, and that any concentration thereof effective in saponifying the fatty acid or acids can be used in the process of the present invention.

The fatty acid or acids used herein are also any fatty acids conventionally used in anionic froth flotation operations, such as tall oils, fatty acids derived from animal and vegetable oils, organic high-molecular weight acids and mixtures thereof. The amount of the fatty acid used is about 0.2 to about 2.0, preferably about 0.7 to about 1.5, more preferably about 0.9 to about 1.3 and most preferably about 0.9 to about 1.1 pounds/ton of dry flotation feed (pounds/t dry feed).

The hydrocarbon oil used in the process of the invention is any of the oils commonly used in phosphate ore processing, such as kerosene, fuel oil, Number 5 fuel oil, or any other suitable hydrocarbon oil. It is also possible to use a mixture of such oils, such as a mixture of kerosene and fuel oil. The most preferred hydrocarbon oil used herein is Number 5 fuel oil. The amount of the hydrocarbon oil used is such that the weight ratio of the hydrocarbon oil to the fatty acid is about 2:1 to about 3:1, preferably about 2.2:1 to about 3:1, and most preferably about 2.4:1 to about 2.7:1.

The conditioning step may be conducted in any suitable manner. However, it is critical to condition the feed with the alkaline agent first, before conditioning it with the hydrocarbon oil and the fatty acid. For example, in commercial operations, the alkaline agent is introduced into the first of a series of stirred tanks and the hydrocarbon oil and the fatty acid are introduced into a separate stirred tank, downstream from the tank where the alkaline agent was introduced. After the ore is conditioned, it is introduced into the vertical column of the present invention to separate the mineral values from the gangue of the ore.

The column of this invention may either be used as a single step replacement for the multiple step flotation process comprising the rougher and the cleaner flotation steps conducted in Denver Flotation Cells, described above, or as a replacement for only the rougher flotation step of the aforementioned multiple step flotation process. If the column is used as a replacement only of the rougher flotation step of the multiple step flotation process, it is followed by the conventional cleaner flotation step conducted in a conventional manner in any conventional flotation apparatus, e.g., in a Denver flotation cell. This is the preferred embodiment of the invention because it produces product of substantially higher purity (higher % BPL) at somewhat higher recovery than the conventional two-step flotation process. In this embodiment of the invention, the amount of the fatty acid used in the conditioning step is that set forth above, i.e., about 0.2 to about 2.0, preferably about 0.7 to about 1.5, more preferably about 0.9 to about 1.3 and most preferably about 0.9 to about 1.1 lbs./t of dry feed, which is somewhat higher than the used in the conventional multiple-step flotation process, all steps of which are conducted in conventional Denver Flotation Cells. The higher amount of fatty acid increases the recovery (yield) of the process, while substantially maintaining the purity of the product at the same level as with lesser amounts of fatty acid. In contrast, it is known in the art that increasing the amount of fatty acid beyond 0.7 lbs./t dry feed in the conventional multiple step process using Denver Flotation Cells in all steps increases recovery at the expense of product purity.

In this preferred embodiment of the invention, the product of the rougher flotation step, i.e., the effluent from the top of the column of this invention, is first diluted with water to about 35% solids, treated with a mineral acid, such as phosphoric or sulfuric acid, preferably sulfuric acid, in a sufficient amount to adjust the pH to about 3.0, and then it is stirred at that pH for about 3 minutes. The acidified effluent is then washed with water two times to remove the rougher flotation chemicals. The water is decanted, and the solids, diluted with additional water, are conducted to the cleaner flotation step.

The cleaner flotation step is conducted in a conventional flotation machine, preferably in a Denver Subaeration Impeller Flotation Machine. Such a machine is known to those skilled in the art and it comprises at least one cell, e.g., in the shape of a cube, containing a centrally placed stationary outer shaft. Within the stationary shaft is located a moving shaft having a rotating impeller attached to the bottom thereof. The stationary shaft has a diffuser attached thereto. The diffuser normally comprises a rigid member having a number of openings therein. The diffuser promotes uniform distribution of air throughout the cell. In operation, air is drawn into the stationary shaft and the impeller distributes the air through the diffuser into the cell. The impeller helps suspend and circulate solid material from the bottom of the cell. In the cleaner flotation step, silica particles, rendered floatable by addition of amine and kerosene, are concentrated at the top of the cell, usually in a launder, and removed from the machine. The non-floatable phosphate is concentrated at the bottom and either removed as product or conducted to a subsequent cell for further separation. Thus, the terms "Denver Flotation Cell" or "Denver Flotation Machine", as used in this application, designate the conventional flotation machine described in this paragraph.

In the operation of the cleaner flotation cell, the diluted solids are conducted as an aqueous suspension into the cleaner flotation cell. If necessary, ammonium hydroxide or other base is added to the cleaner flotation cell to adjust the pH to about 7.0. Subsequently, an amine, such as a fatty amine, e.g., MG-3014 Amine, made by Sherex Chemical Company, Dublin, Ohio, and optionally an antifoaming agent, such as kerosene, are added to the cleaner flotation cell. The amount of the amine is about 0.3 to about 1.0, preferably about 0.4 to about 0.8, and most preferably about 0.4 to about 0.6 lbs./ton of the cleaner flotation feed. If kerosene is used, the weight ratio of the amount thereof to amine is about 0.1 to about 1.0, preferably about 0.4 to about 0.6.

If the column of the invention is used to replace both steps of the multiple step flotation process of the prior art, the amount of fatty acid used in the conditioning step is substantially the same as in the prior art multiple-step flotation process, i.e., it is about 0.4 to about 1.1, preferably about 0.5 to about 0.9, and most preferably about 0.6 to about 0.9 lbs./t of dry feed. In this embodiment of the invention, the column produces, in a single step flotation operation, phosphate product at substantially the same recovery and of substantially the same purity as the multiple-step conventional flotation process of prior art conducted in multiple Denver Flotation Cells.

The invention will now be described in conjunction with one exemplary embodiment thereof, illustrated in the attached figures. However, it will be apparent to those skilled in the art that neither the process nor the apparatus of the present invention is limited to this exemplary embodiment thereof.

Figure 2:
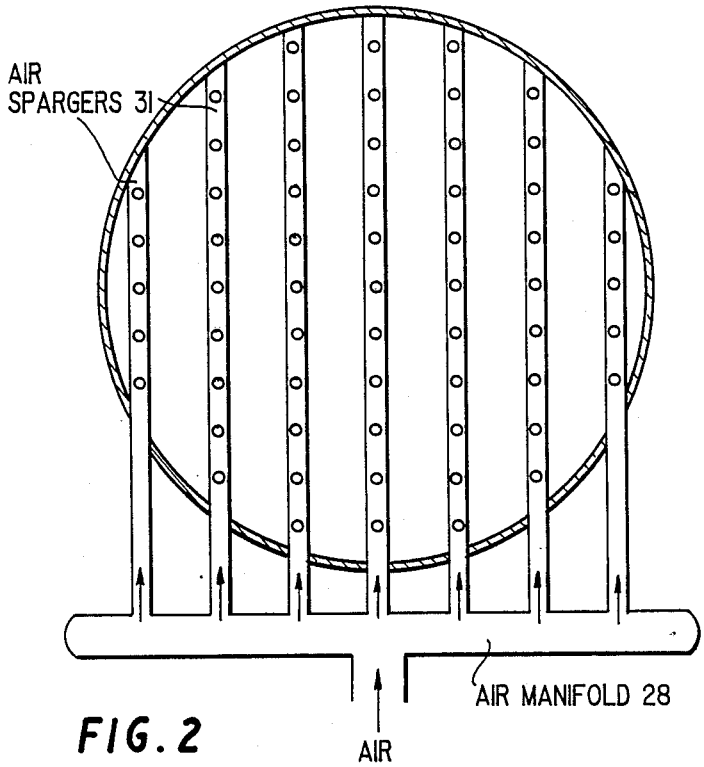
FIG. 2 is a top view of an air sparger unit.

Water is introduced into a column 1 through water inlets 8, 21 and. optionally, 7 (FIG. 1). The introduction of water through inlet 8 is important to obtain high grade of phosphate product. The water introduced through the inlet 21 is forced to pass through a fluidizing plate 2. Usually about 25% of the total amount of water is introduced at the top of the column through the inlet 8, and, optionally, inlet 7. Air is introduced into the column through a line 27, a manifold 28, (FIG. 2) and air spargers 31 and 32 (FIG. 2). The air spargers are made of standard pipe with holes drilled throughout the length of the pipe. For an even distribution of air, two air sparging sections 31 and 32 are provided, one above the other. The air sparging section 31 is placed perpendicularly above the air sparging section 32 to provide a criss-cross pattern. However, it will be apparent to those skilled in the art that any other suitable arrangement of the air sparging sections may be utilized, such as a hub-and-spoke configuration, for each of the two air sparging sections, with each of the sections being staggered with respect to the other. A previously-conditioned phosphate ore feed is introduced into the column through an inlet 3, located at a point at least about 10% of the height of the column, preferably between about 25% and about 70% of the height of the column, and most preferably about 25% and about 50% of the height of the column, as measured from the bottom thereof. A froth line 11 is formed in the column, above which there is established a froth zone relatively rich in phosphate ore, and immediately below which there may be established a zone of relatively low concentration of solids, hereinafter referred to as the "zone of relatively low solids content", or "zone of relatively low particulate material content." The zone of relatively low particulate material content, if formed, contains less than about 7%, preferably less than about 5%, and most preferably about 2 to about 3% by volume of the particulate material. The froth zone or layer has the height of about 10 to about 100%, preferably about 50 to about 100%, of the height of the zone of the relatively low particulate material content, and most preferably it is substantially equal to the height of the zone of the relatively low particulate material content, if the latter is formed. In any event, the height of the froth layer is about 6 to about 36 inches, preferably about 12 to about 24 inches and most preferably about 12 to about 16 inches. The upper boundary of the froth layer is at the top of the column. The froth layer defines the rate of product flow for a product of the desired grade. The froth layer advantages in an upward direction, terminating at the top of column 17 and overflowing into the concentrate launder 15, comprising a sloping bottom portion 16, which facilitates the flow of the concentrated ore from the column through a product outlet 18. The gangue of the ore, comprising mostly sand, flows in a downward direction through the column and exits through the outlet 19. The column contains a number of stationary baffles 23. The baffles are necessary to provide sufficiently turbulent conditions in the column which are crucial for providing an effective separation of the mineral particles from the gangue. The baffles, together with the control of the flow rates of air, water and feed, create a substantial amount of turbulence within the zones defined by consecutive baffles, thereby providing the turbulent conditions within the entire column necessary for an efficient separation of the mineral values from the non-floatable material. Since the turbulence is controlled by the baffles and the flow rates of various streams into the column, the column of the invention is operated with no internal moving mechanical parts. In contrast, prior art apparatus used in the rougher flotation step required the use of stirrers or similar mechanical stirring devices. The number and spacing of the baffles can be readily determined by those skilled in the art to obtain optimum performance. In the preferred embodiment, the baffles are spaced 12 inches from each other and contain a plurality of circular openings (FIG. 3) which occupy about 35% of each baffle's area.

Figure 3:
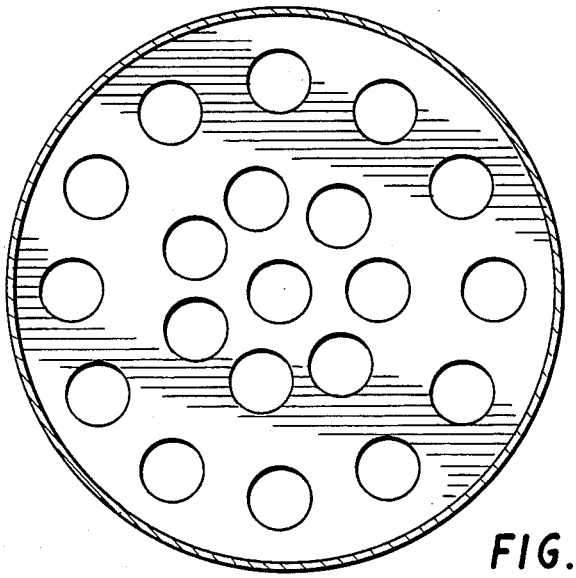
FIG. 3 is a schematic representation of the baffles used in the column depicted in FIG. 1.

The baffles used in the column may be of any shape or cross-sectional area known to those skilled in the art, so long as they provide adequate turbulence in the column to separate the mineral values from the relatively non-flotatable particulate material, such as gangue. The hatched areas in the baffles of FIG. 3 represent solid areas, while blank, white areas represent open areas through which the water, air, and the conditioned solution of the phosphate ore flow. It will be apparent to those skilled in the art that any other baffles design may be used, so long as it and the flow rates, defined below, of the various streams introduced into the column provide a sufficient amount of turbulence within the column.

It is significant that no frothing additive agent is required for the successful operation of the column of this invention. Without wishing to be bound by any theory of operability, it is believed that the addition of a frothing agent, such as those commonly used in prior art, has a detrimental effect on the effectiveness of the flotation because it reduces the turbulence within the column to the lower level than that required for the effective column operation.

To obtain a sufficient amount of turbulence in the column for an effective and efficient separation of the phosphate values for the gangue, the flow rate of air in the column (superficial velocity, i.e., volumetric rate of air flow per cross-sectional column area) must be about 150 to about 1800, preferably about 200 to about 1100, more preferably about 350 to about 850 and most preferably about 583 cubic feet per square foot of cross-sectional column area per hour ($ft^3/ft^2$-hr); the flow rate of water must be at least greater than about 275, preferably about 700 to about 5000, and most preferably about 800 to about 2000 gallons per hour per square foot of cross-sectional column area; and the flow rate of the phosphate feed must be about 0.2 to about 3.5, preferably about 0.45 to about 2.7, and most preferably about 0.8 to about 2.0 dry tons of the phosphate feed per square foot of the cross-sectional area per hour. In this connection, the rate of introduction of the feed is calculated on the basis of dry feed, with the specific gravity thereof being 2.65 grams per cubic centimeter. The air sparging velocity, i.e., the velocity of air exiting from the openings of the air spargers, is about 50 to about 400 feet per second (ft/sec), preferably about 100 to about 300 ft/sec, and most preferably about 150 to about 250 ft/sec. The column described herein and illustrated in FIG. 1 is operated at air sparging velocity of about 200 to about 250 ft/sec.

The process and apparatus of the present invention, when used as the replacement for the rougher flotation step only of the multiple step flotation process, followed by the cleaner flotation step, produce a phosphate product of higher purity and at higher yield than the product obtained with the conventional rougher and cleaner flotation steps, both conducted in conventional Denver Flotation Cells. The recovery obtained in this embodiment of the invention is about 1 to about 4% higher and the concentrate grade about 1 to about 3% BPL greater than those obtained with conventional two-step flotation processes of the prior art conducted in Denver Flotation Cells. In the absence of turbulent conditions generated by the apparatus and process of this invention, a substantially similar flotation column operated at substantially quiescent conditions would produce a phosphate-rich product at about the same recovery level but at the concentrate grade of about 10% BPL lower than those obtained with the apparatus and process of the present invention operated at the turbulent conditions crucial to the present invention.

The term "recovery" as used herein is intended to mean the percentage of the mineral values, e.g., phosphate, in the feed reporting to the product concentrate.

The term "grade" as used herein is intended to mean the concentration of the desired mineral in the recovered product. For example, for a phosphate ore, grade is expressed as $$\% BPL = \frac{\% P_2O_5}{0.4576}.$$

Without wishing to be bound by a theory of operability, it is believed that the recovery of the product of the high grade is obtained because of the relatively highly turbulent conditions within the column created by the baffles and by the flow rates of the air, the water, and the feed, identified above.

The following Examples further illustrate the essential features of the invention. However, it will be apparent to those skilled in the art that the specific equipment and conditions used in the Examples do ont limit the scope of the invention.

EXAMPLE 1

(COMPARISON OF FLOTATION IN THE COLUMN USED AS A ROUGHER FLOTATION MACHINE WITH CONVENTIONAL TWO-STEP FLOTATION)

In this Example, the conventional two-step flotation process with both steps conducted in Denver Flotation Cells, was compared to a two-step flotation process using the column of the invention for the rougher flotation step and a conventional Denver Flotation Cell of the cleaner flotation step.

A. Experimental Procedure

The rougher conditioning operation used for both the conventional two-step flotation of prior art and turbulent column flotation of the invention was the same. In this operation, flotation feed was added to a cylindrical vessel and diluted to 70% solids with water. At that point, 10% $NH_4OH$ was added and stirred with the feed for 30 seconds. The pH was about 9.5. Fatty acid and fuel oil (in the amounts indicated in Table I) were then added simultaneously to the vessel and mixed with the feed for 90 seconds. The pH was about 9.1 after this operation.

In column flotation, the conditioned feed was pumped to the column, the phosphate product was floated and recovered from the column, then "de-oiled" and processed in a conventional cleaner flotation step, described below. The specific conditions for these runs, including column dimensions and flow rates, are outlined in Table II. Water was sprayed at the top and added at the bottom of the column (e.g., lines 8 and 21, respectively, in FIG. 1). Air was introduced near the bottom of the column (e.g., through line 27 in FIG. 1). The product of the column flotation was diluted with water to 35% solids and "de-oiled" with sulfuric acid at a pH of 3.0. The material was then washed several times with water and conducted to a cleaner flotation step conducted in a Denver Unit this Size D-12 Cell substantially in the manner described below for the two-step conventional flotation.

In the conventional prior art two-step flotation (comparative flotation) the condition feed was first subjected to a standard "rougher flotation" in a Denver Flotation Cell, Denver Unit Size D-12, made by the Denver Equipment Division of Joy Manufacturing Company, in which the phosphate was floated away from most of the silica. The material that floated was then diluted with water to 35% solids and "de-oiled" with sulfuric acid at a pH of 3.0. The material was then washed several times with water.

The washed material was then subjected to a "cleaner flotation", also in the Denver Unit Size D-12 Cell, in which amine and kerosene were added to make the silica floatable. The amine and kerosene loadings are set forth in Table I. The amine was MG-3014 Amine available from the Sherex Chemical Company, Dublin, Ohio. A sufficient amount of ammonia was added to the system to maintain flotation pH of 7.0. The silica which floated in this cleaner flotation step was discarded and the phosphate "sink" was recovered as a product.

B. Results

A summary of laboratory runs comparing a two-step flotation process utilizing the column of the invention in the rougher flotation step, followed by a conventional Denver Flotation cleaner flotation step with the comparative flotation is presented in Table I. As this table shows, the column flotation achieved about 1.5 to about 2% BPL higher grade and about 0.5 to about 3% higher recovery in this set of experiments. It is believed that the primary reason for this improvement is that the performance of the column of the invention is superior to that of the conventional rougher flotation step, since the column used in the rougher flotation step produces a product having about 15 to about 19% BPL higher grade than the conventional rougher flotation step at a substantially equivalent phosphate recovery level.

TABLE I

Comparison of Column Rougher/Conventional Cleaner Two-Step Flotation Process with the Conventional Denver Two-Step Flotation Process

| Column Rougher/Conventional Cleaner Two-Step Process | | | | | | Conventional Denver Two-Step Process | | | | |
|---|---|---|---|---|---|---|---|---|---|---|
| First Step Column | | | | Overall (Two Steps) | | First Step (Rougher) | | | Overall (Two Steps) | |
| Feed Grade (% BPL) | Fatty Acid Loading (lbs/ton feed) | Conc. Grade (% BPL) | % Phosphate Recovery | Conc. Grade (% BPL) | % Phosphate Recovery | Fatty Acid Loading (lbs./ton feed) | Conc. Grade (% BPL) | % Phosphate Recovery | Conc. Grade (% BPL) | % Phosphate Recovery |
| 14 | 1.1 | 73.3 | 91.0 | 77.3[1] | 85.8 | 0.7 | 57.7 | 90.7 | 75.6[2] | 83.0 |
| 16 | 1.1 | 72.9 | 92.5 | 75.0[2] | 87.7 | 0.7 | 64.1 | 91.2 | 73.6[2] | 87.2 |

[1]Amine loading = 0.4 lbs/ton cleaner feed
[2]Amine loading = 0.6 lbs/ton cleaner feed
Note:
Fuel Oil: fatty acid ratio (by weight) = 2.5:1
Amine: kerosene ratio (by weight) = 2:1

TABLE II

Experimental Conditions Used In Turbulent Column Flotation Runs In Comparison With Conventional Two-Step Flotation

| Variable | Value |
|---|---|
| * Column Inside Diameter (inches) | 4 |
| * Column Height (inches) | 72 |
| * Distance Between Baffles (inches) | 4 |
| * Feed Inlet, Distance From Bottom (inches) | 20 |
| * Feed Rate (Dry tons/Hr/Ft$^2$) | 1.15 |
| * Water Rate (Gal/Hr/Ft$^2$) | 1031 |
| * Air Rate (Ft$^3$/Hr/Ft$^2$) | 583 |

EXAMPLE 2 (COMPARISON OF DENVER ROUGHER FLOTATION WITH ROUGHER FLOTATION IN THE COLUMN)

In this example, the performance of the column of the invention used to conduct rougher flotation was compared with the performance of the conventional Denver Flotation Cell used to conduct the rougher flotation step. The column used in this Example was the same as the column of Example 1 and the rougher flotation in the Denver Flotation Step was conducted substantially in the manner in which that step was conducted in Example 1. The pertinent operating parameters and the results of the comparison are summarized in Table III.

TABLE III

Comparison of Column "Rougher" Flotation and Conventional Denver Rougher Flotation

| Column "Rougher" Flotation | | | | Conventional Denver Rougher Flotation | | |
|---|---|---|---|---|---|---|
| Feed Grade (% BPL) | Fatty Acid Loading (lbs/ton feed) | Conc. Grade (% BPL) | % Phosphate Recovery | Fatty Acid Loading (lbs./ton feed) | Conc. Grade (% BPL) | % Phosphate Recovery |
| 14 | 1.1 | 73.3 | 91.0 | 0.7 | 57.7 | 90.7 |
| 14 | 1.1 | 72.6 | 92.4 | 0.9 | 52.7 | 93.5 |
| 16 | 1.1 | 73.1 | 91.8 | 0.7 | 64.1 | 91.2 |
| 16 | 1.1 | 72.3 | 93.5 | 0.9 | 57.1 | 93.5 |
| 22 | 0.9 | 74.8 | 93.6 | 0.9 | 51.9 | 93.9 |

Fuel Oil: Fatty Acid Ratio (by weight) = 2.5:1
Feed is nominally −35 + 150 mesh

The results indicate that at equivalent levels of phosphate recovery, the grade of phosphate product obtained from the column is about 9–23% BPL higher than that obtained from conventional Denver-type sub-aeration flotation machines.

EXAMPLE 3

COMPARISON OF FLOTATION IN THE COLUMN OF THE INVENTION WITH QUIESCENT COLUMN FLOTATION

A. Experimental Procedure

The rougher conditioning operation described in Example 1 was used for both types of column flotation. In these comparative runs, a 2 inch internal diameter (ID) column was used, whereas a 4 inch ID column was used in Example 1. Also, the 2 inch column was operated in a batch mode instead of continuously. Because of this, there was no feed rate or feed injection point. 1400 grams of fine flotation feed (−35 to +150 mesh) from Fort Meade, Fla., was introduced into the column. The air rate was 223 $Ft^3/Hr/Ft^2$ of column cross-sectional area. The water rate was not measured.

In the runs illustrating quiescent column flotation operation similar to that of Hollingsworth, U.S. Pat. Nos. 3,371,779, 4,287,054 and 4,431,531, frother was added to the column just prior to the introduction of air. The frother stabilized the air bubbles and produced a more quiescent flotation. Additionally, the baffles were removed from the column to achieve quiescent conditions.

B. Results

The results, summarized in Table IV, establish that the turbulent conditions obtained with the flotation column of the invention produce about 12% BPL higher product grade than the quiescent conditions in the same column.

TABLE IV

Comparison Of Turbulent And Quiescent Column Flotation In Laboratory Runs With Fine Ft. Meade Feed

| Turbulent Column Flotation | | Quiescent Column Flotation | |
|---|---|---|---|
| Concentrate Grade (%BPL) | Phosphate Recovery (%) | Concentrate Grade (%BPL) | Phosphate Recovery (%) |
| 74.1 | 94.8 | 62.1 | 95.2 |
| 73.2 | 95.5 | 60.9 | 95.8 |

Figure 4:
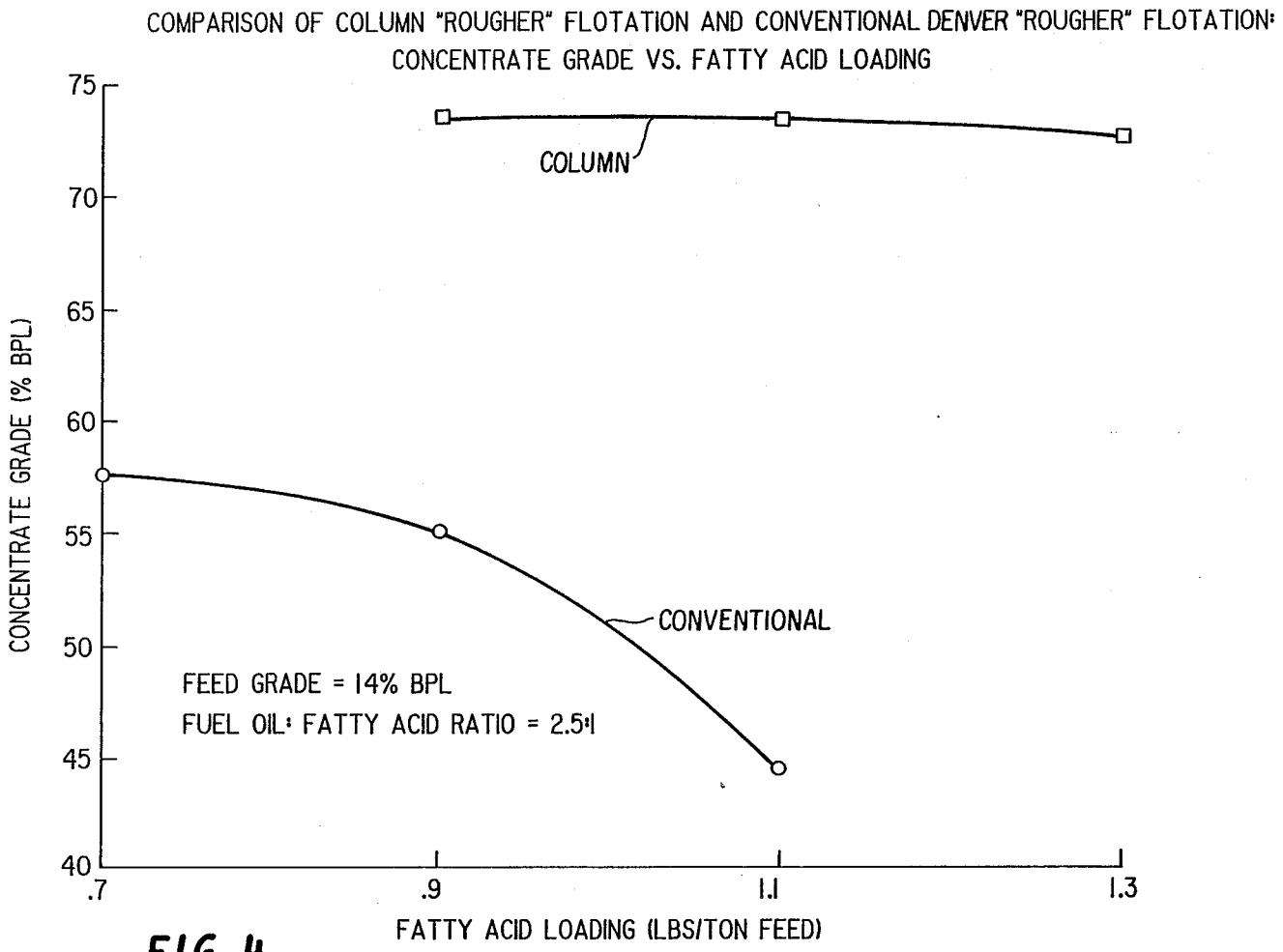
FIG. 4 is a graph comparing the concentrate grade as a function of fatty acid loading in a phosphate ore obtained with the column and process of the invention with that obtained with a conventional Denver rougher flotation step.

*Fatty Acid Loading = 0.7 lbs/ton feed
*Wt. Fuel Oil/Fatty Acid Ratio = 3:1
*Feed Grade = 22% BPL The higher selectivity of the invention flotation process in the column of this invention is also illustrated by the data of FIG. 4. The data indicates that as fatty acid loading is increased, the product grade obtained in a conventional Denver Flotation decreases substantially (from about 58 to about 44% BPL). However, the product grade obtained in the process conducted in the column is substantially independent of fatty acid loading. This would enable a process operator to increase the fatty acid loading in the column to increase recovery without sacrificing the product grade.

It will be apparent to those skilled in the art that the specific embodiments discussed above can be sucessfully repeated with ingredients equivalent to those generically or specifically set forth above and under variable process conditions.

From the foregoing specification, one skilled in the art can readily ascertain the essential features of this invention and without departing from the spirit and scope thereof can adapt it to various diverse applications.

We claim:

1. A single step, continuous fractionating flotation process for separating a phosphate ore-containing material from a mixture thereof with a non-floatable particulate material comprising:

(i) introducing the mixture into a vertical flotation column containing a liquid, the column comprising at least one baffle means to promote turbulence therein;

(ii) introducing a gaseous material into the vertical column below the point of introduction of the mixture;

(iii) introducing the liquid into the column, the rate of introducing the mixture, the gaseous material and the liquid, and the baffle means being sufficient to create a substantial amount of turbulence in the vertical column to separate the phosphate ore-containing material from the non-flotatable particulate material;

(iv) recovering the phosphate ore-containing material at an upper portion of the vertical flotation column; and (v) recovering the non-floatable particulate material in a lower portion of the vertical column.

2. A process of claim 1 wherein the mixture has a particle size of less than 20 mesh.

3. A process of claim 2 wherein the phosphate ore-containing material is phosphate and the non-floatable particulate material comprises silica.

4. A process of claim 3 wherein the liquid is an aqueous liquid and the gaseous material comprises oxygen.

5. A process of claim 4 wherein the aqueous liquid is water and the gaseous material is air.

6. A process of claim 5 wherein the mixture is introduced into the column at the rate of about 0.2 to about 3.5 ton, on dry basis, per square foot ($ft^2$) of the vertical column cross-section area per hour.

7. A process of claim 6 wherein the flow rate of water in the column is at least greater than about 275 gallons per hour per $ft^2$ of the vertical column cross-sectional area.

8. A process of claim 7 wherein the flow rate of air in the vertical column is about 150 to about 1800 $ft^3$ per hour per $ft^2$ of the vertical column cross-sectional area.

9. A process of claim 8 wherein the baffle means is stationary.

10. A process of claim 9 wherein the column contains no internal moving mechanical parts.

11. A process of claim 10 wherein there is formed in the column a zone of relatively low particulate material content comprising not more than about 7% by volume of the particulate material.

12. A process of claim 11 wherein the zone of relatively low particulate material content comprises not more than about 5% by volume of the particulate material.

13. A process of claim 12 wherein the zone of relatively low particulate material content comprises about 2 to about 3% by volume of the particulate material.

14. A process of claim 13 wherein there is formed in the column, above the zone of relatively low particulate material content, a froth layer zone.

15. A process of claim 14 wherein the height of the froth layer zone is equal to about 25–100% of the height of the zone of relatively low particulate material content.

16. A process of claim 15 wherein the height of the froth layer zone is about 50–100% of the height of the zone of relatively low particulate material content.

17. A process of claim 16 wherein the height of the froth layer zone is substantially equal to the height of the zone of relatively low particulate material content.

18. A process of claim 17 wherein the mixture is introduced into the column at the rate of about 0.45 to about 2.7 ton, on dry basis, per square foot of the vertical flotation column's cross-sectional area per hour.

19. A process of claim 18 wherein the mixture is introduced into the column at the rate of about 0.8 to about 2.0 ton, on dry basis, per square foot of the vertical column cross-sectional area per hour.

20. A process of claim 19 wherein the water is introduced into the column at the rate of about 700 to about 5000 gallons per hour per $ft^2$ of the vertical column cross-sectional area.

21. A process of claim 20 wherein the flow rate of water in the column is about 800 to about 2000 gallons per hour per $ft^2$ of the vertical column cross-sectional area.

22. A process of claim 21 wherein the air flows in the column at the rate of about 200 to about 1100 $ft^3$ per hour per $ft^2$ of the column cross-sectional area.

23. A process of claim 22 wherein the air flows in the column at the rate of about 350 to about 850 $ft^3$ per hour per $ft^2$ of the column cross-sectional area.

24. A process of claim 23 wherein the froth layer zone is separated from the zone of relatively low particulate material content by a froth line.

25. A process of claim 24 wherein the mixture, prior to the introduction thereof into the column, is conditioned by first contacting it with an alkaline agent, and subsequently with a hydrocarbon oil and with a fatty acid.

26. A process of claim 25 wherein the alkaline agent is used as about 5 to about 15% by weight aqueous solution, and it is a base of alkali metal, a base of alkaline metal, ammonium hydroxide, a carbonate of sodium, a carbonate of potassium or mixtures thereof.

27. A process of claim 26 wherein the fatty acid is used in the amount of about 0.2 to about 2.0 lbs/ton of the mixture on dry basis, and it is tall oils, fatty acids derived from animal and vegetable oils, organic high molecular weight acids or a mixture thereof.

28. A process of claim 27 wherein the fatty acid is used in the amount of about 0.7 to about 1.5 lbs/ton of the dry mixture.

29. A process of claim 28 wherein the fatty acid is used in the amount of about 0.9 to about 1.3 lbs/ton of the dry mixture.

30. A process of claim 29 wherein the fatty acid is used in the amount of about 0.9 to about 1.1 lbs/ton of the dry mixture.

31. A process of claim 30 wherein the hydrocarbon oil is used in such an amount that a weight ratio of the hydrocarbon oil to the fatty acid is about 2.1 to about 3.1.

32. A process of claim 31 wherein the hydrocarbon oil is used in such an amount that the weight ratio of the hydrocarbon oil to the fatty acid is about 2.2:1 to about 3:1.

33. A process of claim 32 wherein the hydrocarbon oil is used in such an amount that the weight ratio of the hydrocarbon oil to the fatty acid is about 2.4:1 to about 2.7:1.

34. A flotation process for separating a phosphate ore-containing material from a mixture thereof with a non-floatable particulate material comprising:

(A) recovering at least a portion of the phosphate ore-containing floatable particulate material from the mixture in a rougher flotation step comprising the consecutive steps of:

(i) introducing the mixture into a vertical flotation column containing a liquid, the column comprising at least one baffle means to promote turbulence therein;

(ii) introducing a gaseous material into the vertical column below the point of introduction of the mixture;

(iii) introducing the liquid into the column, the rate of introducing the mixture, the gaseous material and the liquid, and the baffle means being sufficient to create a substantial amount of turbulene in the vertical column to separate the phosphate ore-containing material from the non-floatable particulate material;

(iv) recovering the phosphate ore-containing material in an upper portion of the vertical column; and (v) recovering the non-floatable particulate material in a lower portion of the vertical flotation column;

(B) subjecting to a flotation in a cleaner flotation step the phosphate ore-containing material recovered from said step (iv) of the rougher flotation step.

35. A process of claim 34 wherein the mixture has a particle size of less than 20 mesh.

36. A process of claim 35 wherein the phosphate ore-containing material is phosphate and the non-floatable particulate material comprises silica.

37. A process of claim 36 wherein the liquid is an aqueous liquid and the gaseous material comprises oxygen.

38. A process of claim 37 wherein the aqueous liquid is water and the gaseous material is air.

39. A process of claim 38 wherein the mixture is introduced into the column at the rate of about 0.2 to about 3.5 ton, on dry basis, per square foot ($ft^2$) of the vertical column cross-sectional area per hour.

40. A process of claim 39 wherein the flow rate of water in the column is at least greater than about 275 gallons per hour per $ft^2$ of the vertical column cross-sectional area.

41. A process of claim 40 wherein the flow rate of air in the vertical column is about 150 to about 1800 $ft^3$ per hour per $ft^2$ of the vertical column cross-sectional area.

42. A process of claim 41 wherein the baffle means is stationary.

43. A process of claim 42 wherein the column contains no internal moving mechanical parts.

44. A process of claim 43 wherein the mixture is introduced into the column at the rate of about 0.45 to about 2.7 ton, on dry basis, per square foot of the vertical flotation column's cross-sectional area per hour.

45. A process of claim 44 wherein the mixture is introduced into the column at the rate of about 0.8 to about 2.0 ton, on dry basis, per square foot of the vertical column cross-sectional area per hour.

46. A process of claim 45 wherein the water is introduced into the column at the rate of about 700 to about 5000 gallons per hour per $ft^2$ of the vertical column cross-sectional area.

47. A process of claim 46 wherein the flow rate of water in the column is about 800 to about 2000 gallons per hour per $ft^2$ of the vertical column cross-sectional area.

48. A process of claim 47 wherein the air flows in the column at the rate of about 200 to about 1100 $ft^3$ per hour $ft^2$ of the column cross-sectional area.

49. A process of claim 48 wherein the air flows in the column at the rate of about 350 to about 850 $ft^3$ per hour per $ft^2$ of the column cross-sectional area.

50. A process of claim 49 wherein the mixture, prior to the introduction thereof into the column, is conditioned by first contacting it with an alkaline agent, and subsequently with a hydrocarbon oil and with a fatty acid.

51. A process of claim 50 wherein the fatty acid is used in the amount of about 0.2 to about 2.0 lbs/ton of the mixture on dry basis, and it is tall oils, fatty acids derived from animal and vegetable oils, organic high molecular weight acids or a mixture thereof.

52. A process of claim 51 wherein the fatty acid is used in the amount of about 0.7 to about 1.5 lbs/ton of the dry mixture.

53. A process of claim 52 wherein the fatty acid is used in the amount of about 0.9 to about 1.3 lbs/ton of the dry mixture.

54. A process of claim 53 wherein the fatty acid is used in the amount of about 0.9 to about 1.1 lbs/ton of the dry mixture.

55. A process of claim 54 wherein the cleaner flotation step is conducted in a flotation apparatus comprising a vessel and a stirring means, wherein a material comprising silica is recovered at the top of the vessel and the material comprising phosphate is concentrated at the bottom thereof.

56. A process of claim 55 wherein the effluent of said step (iv) of the rougher flotation step is treated with a mineral acid prior to the introduction thereof to the cleaner flotation step.

57. A process of claim 56 wherein the mineral acid is sulfuric acid.

58. A process of claim 57 wherein an amine is introduced into the cleaner flotation step.

59. A process of claim 58 wherein the amine is a fatty amine.

60. A process of claim 1 wherein the column contains no internal moving mechanical parts.

61. A process of claim 34 wherein the column contains no internal moving mechanical parts.

62. A process of claim 61 wherein the air flows into the column at the rate of about 583 $ft^3$ per hour per $ft^2$ of the column cross-sectional area.

63. A process of claim 62 wherein the mixture has a particle size of less than 35 mesh.

64. A process of claim 33 wherein the air flows into the column at the rate of about 583 $ft^3$ per hour per $ft^2$ of the column cross-sectional area.

65. A process of claim 64 wherein the mixture has a particle size of less than 35 mesh.

* * * * *